US005299600A

United States Patent [19]

Aronovich

[11] Patent Number: 5,299,600

[45] Date of Patent: Apr. 5, 1994

[54] ANALOG PROPORTIONAL PRESSURE CONTROL THREE-WAY VALVE

[75] Inventor: Felix Aronovich, Buffalo Grove, Ill.

[73] Assignee: Sterling Hydraulics, Inc., Schaumburg, Ill.

[21] Appl. No.: 944,417

[22] Filed: Sep. 14, 1992

[51] Int. Cl.[5] ..... F15B 13/044

[52] U.S. Cl. ..... 137/625.65; 251/129.08; 251/129.15; 335/261

[58] Field of Search ..... 137/625.65; 251/129.08, 251/129.15; 335/261

[56] References Cited

U.S. PATENT DOCUMENTS

| | | | |
|---|---|---|---|
| 3,168,242 | 2/1965 | Diener | 251/129.08 X |
| 3,914,952 | 10/1975 | Barbier | 251/129.08 X |
| 4,313,590 | 2/1982 | Nishimiya | 251/129.08 |
| 4,361,309 | 11/1982 | Sogabe | 251/129.08 |
| 4,411,406 | 10/1983 | Inada et al. | 251/129.08 X |
| 4,442,998 | 4/1984 | Ohyama et al. | 251/129.08 |
| 4,491,153 | 1/1985 | Bartholomaus | 137/625.65 |
| 4,509,716 | 4/1985 | Barber et al. | 251/129.15 X |
| 4,540,154 | 9/1985 | Kolchinsky et al. | 251/129.15 |
| 4,604,600 | 8/1986 | Clark | 335/261 X |
| 4,638,974 | 1/1987 | Zeuner et al. | 251/129.15 |
| 4,790,345 | 12/1988 | Kolchinsky . | |
| 5,156,184 | 10/1992 | Kolchinsky | 137/625.65 |

FOREIGN PATENT DOCUMENTS

| | | | |
|---|---|---|---|
| 2-173478 | 7/1990 | Japan | 251/129.08 |

OTHER PUBLICATIONS

Internation Publication No. WO91/05195, published 18 Apr. 1991.

*Primary Examiner*—Gerald A. Michalsky

*Attorney, Agent, or Firm*—Wood, Phillips, VanSanten, Hoffman & Ertel

[57] ABSTRACT

An analog proportional pressure control 3-way valve includes an elongate cylindrical valve housing having an axial through bore defining an interior chamber, one end of the housing comprising an end port opening, a plurality of axially spaced side port openings defining an inlet and an outlet, and an axial opposite end comprising a sleeve end receivable in a solenoid, in use. A valve member is movable in the chamber at the port end for selectively controlling fluid pressure through the chamber between the end port opening and the outlet in the neutral position or between the inlet and the outlet in a regulated position. A solenoid plunger is movable in the chamber at the sleeve end and is operatively associated with the valve member for positioning the valve member. A stop is mounted to the housing at the sleeve end for retaining the plunger in the chamber. A pressure dividing circuit divides regulated pressure between the outlet and the end port opening in the regulated position of the valve member to create an intermediate pressure to balance force from the solenoid.

15 Claims, 3 Drawing Sheets

ANALOG PROPORTIONAL PRESSURE CONTROL THREE-WAY VALVE

FIELD OF THE INVENTION

This invention relates to control valves and, more particularly, to an analog proportional pressure control three-way valve.

BACKGROUND OF THE INVENTION

In one form of a fluid pressure control valve, a flow control element, such as a spool or valve member, is movably positioned in a valve chamber between first and second valve positions for selectively fluidically coupling valve ports. The spool member may be directly actuated by a movable armature or plunger. A solenoid controllably positions the plunger, which results in movement of the spool from a neutral position to an actuated position. Typically, a coil spring is used for biasing the spool to the neutral position. Energization of the solenoid coil produces a magnetic force acting on the plunger which is related to a gap between the plunger and a stop. This relationship is represented by a curve in which force is generally inversely proportional to gap. With an on/off type valve, the magnetic force exceeds the opposing spring and flow forces to provide continuous movement of the plunger to a fully actuated position.

With a proportional type valve, it is necessary to control the plunger to stop at intermediate positions. An example of such a proportional valve is shown in Kolchinsky, U.S. Pat. No. 4,790,345. This patent shows a valve housing including a sleeve having first and second tube portions connected by a non-magnetic bridge. The mating surfaces of the bridge and tube portions are conical. This construction changes magnetic behavior as by modifying the above-described curve to provide constant force during the portion of the stroke at which the plunger is at an axial position corresponding to position of the bridge. As a result, the plunger moves until the magnetic force is balanced with the spring and flow forces so that the plunger stops at an intermediate position. As is known, the magnetic force depends on voltage applied to the coil. Thus, by varying coil voltage the stop position varies. Thus, movement of the spool can be controlled to regulate flow by varying input voltage.

In the case of a pressure control valve, a similar tube is used. However, the force of the pressure differential over the cross section of the spool cross section opposes the magnetic force. Therefore, the larger the diameter of the spool, the larger the required magnetic force.

While such typical proportional valves are satisfactory, they are also expensive to produce because of the manufacturing steps required in constructing the tube with the bridge.

Clark, U.S. Pat. No. 4,604,600, discloses an alternative construction having a one piece non-magnetic tube. This valve has a conical lip in either the plunger or stop and not the tube wall. Particularly, this design uses a conical lip on either an outer wall of the stop or the plunger or on an inner recess for a cylindrical nose of either the stop or the plunger. The nose is received in a cylindrical recess on the other of said parts. In all cases, there is a cylindrical joint between the plunger and stop. This construction is believed to provide a poor performance compared to the structures using the magnetic bridge.

It is also desirable to increase regulated pressure capacity for a given solenoid force without decreasing spool diameter. Decreasing spool diameter lowers pressure capacity.

Finally, it is desirable to decrease frictional forces relating to axial sliding movement of the plunger and valve member.

The present invention overcomes one or more of the problems discussed above.

SUMMARY OF THE INVENTION

According to the invention, a proportional valve is disclosed in which regulated pressure capacity is increased without decreasing pressure capacity.

There is disclosed in accordance with one aspect of the invention an elongate cylindrical valve housing having an axial through bore defining an interior chamber, one end of the housing comprising an end port opening, a plurality of axially spaced side port openings defining an inlet and an outlet, and an axial opposite end comprising a sleeve end receivable in a solenoid, in use. A valve member is movable in the chamber at the port end for selectively controlling fluid flow through the chamber between the end port opening and the outlet in the neutral position or between the inlet and the outlet in a regulated position. A solenoid plunger is movable in the chamber at the sleeve end and is operatively associated with the valve member for positioning the valve member. A stop is mounted to the housing at the sleeve end for retaining the plunger in the chamber. Pressure dividing means divide regulated pressure between the outlet and the end port opening in the regulated position of the valve member to create an intermediate pressure to balance force from the solenoid.

It is a feature of the invention that the pressure dividing means comprises a pressure chamber in said valve member, a first orifice connecting the pressure chamber with the outlet and a second orifice connecting the pressure chamber with the end port opening.

It is another feature of the invention that the second orifice is of a size selected to determine pressure capacity of the valve.

It is another feature of the invention that the pressure chamber is defined by a through bore in the valve member and further comprising a plug threadably received in the through bore, the threaded plug including the second orifice.

According to another aspect of the invention a proportional valve is disclosed having an increased force.

There is disclosed in accordance with this other aspect of the invention a proportional solenoid operated fluid pressure control valve comprising an elongate cylindrical valve housing having an axial through bore defining an interior chamber, one end of the chamber comprising a port end having an inlet and an outlet, and an axial opposite end comprising a sleeve and receivable in a solenoid, in use. A valve member is movable in the chamber at the port end for selectively controlling fluid flow through the chamber between the inlet and the outlet. A solenoid plunger is movable in the chamber at the sleeve end and is operatively associated with the valve member for positioning the valve member. The plunger includes a conical nose extending axially from an end opposite the valve member. A stop is mounted to the housing at the sleeve end for retaining the plunger in the chamber. The stop includes a conical recess axially facing the plunger nose for receiving the plunger nose.

It is a feature of the invention that the nose comprises a frusto-conical nose and the recess comprises a frusto-conical recess.

It is another feature of the invention that the housing comprises a one-piece housing.

It is a further feature of the invention that the housing is of non-magnetic material.

It is an additional feature of the invention to provide a non-magnetic shim disposed between the plunger and the stop to limit movement of the plunger.

It is a further feature of the invention to provide a spring for normally biasing the plunger in a select neutral position.

According to a further aspect of the invention a valve is disclosed having decreased friction.

There is disclosed in accordance with this further aspect of the invention a solenoid operated fluid pressure control valve comprising an elongate cylindrical valve housing having an axial through bore defining an interior chamber, one end of the chamber comprising a port end having an inlet and an outlet, an axial opposite end comprising a sleeve end receivable in a solenoid, in use. A valve member is movable in the chamber at the port end for selectively controlling fluid flow through the interior chamber between the inlet and the outlet. A solenoid plunger is movable in the interior chamber at the sleeve end. Means are provided for operatively coupling the plunger to the valve member for positioning the valve member, comprising one end of the valve member being received in a counterbore in the plunger, the one end including a pair of angularly and axially spaced overlapping radially extending openings, a first pin being received in one of the openings and extending into aligned radially extending openings in the plunger and a second pin received in the other of the openings and being captured in the counterbore, so that movement of the plunger and thus the first pin is translated into movement of the second pin and thus the valve member to compensate for non-concentricity between the parts moving relative to one another and eliminate frictional distortion.

It is a feature of the invention that the one radially extending valve member opening is of a larger diameter than the other radially extending valve member opening.

Further features and advantages of the invention will be readily apparent from the specification and from the drawings.

DETAILED DESCRIPTION OF THE INVENTION

Figure 1:
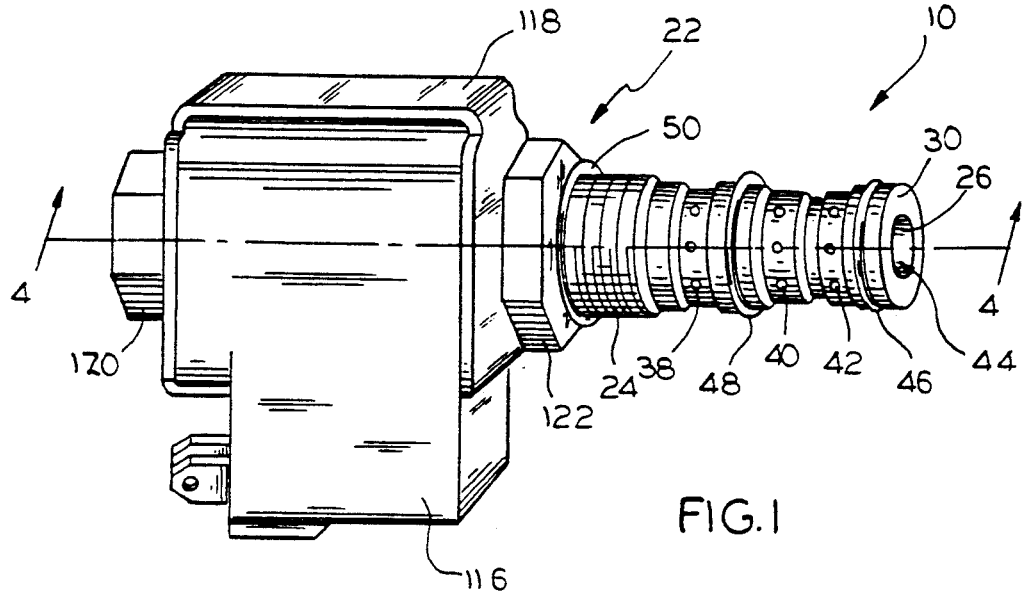
FIG. 1 is a perspective view of an analog proportional control three-way valve according to the invention.
Figure 2:
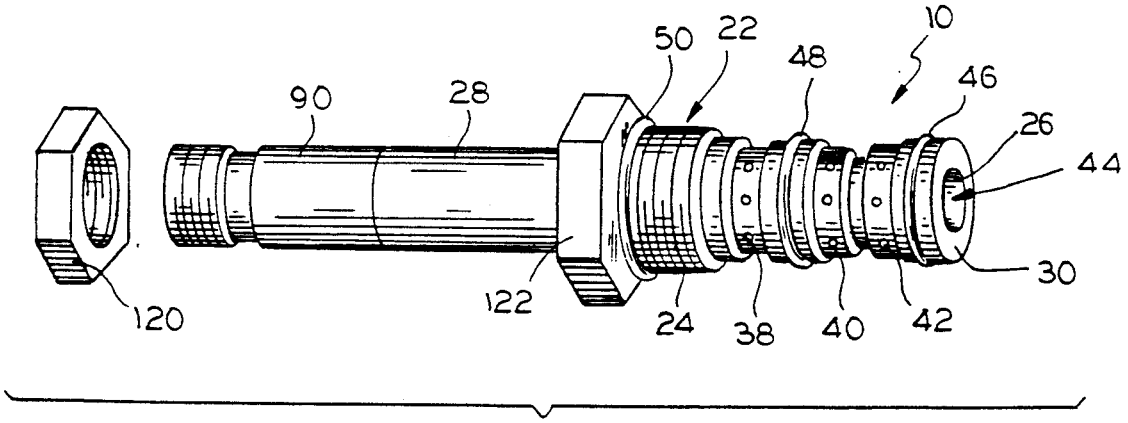
FIG. 2 is an exploded view of the valve of FIG. 1 with the solenoid removed.

FIG. 1 illustrates an analog proportional pressure control three-way valve 10 according to the invention. The valve includes a stationary valve housing 22 having a threaded outer portion 24 adapted to be threaded into a fluid port (not shown).

Figure 4:
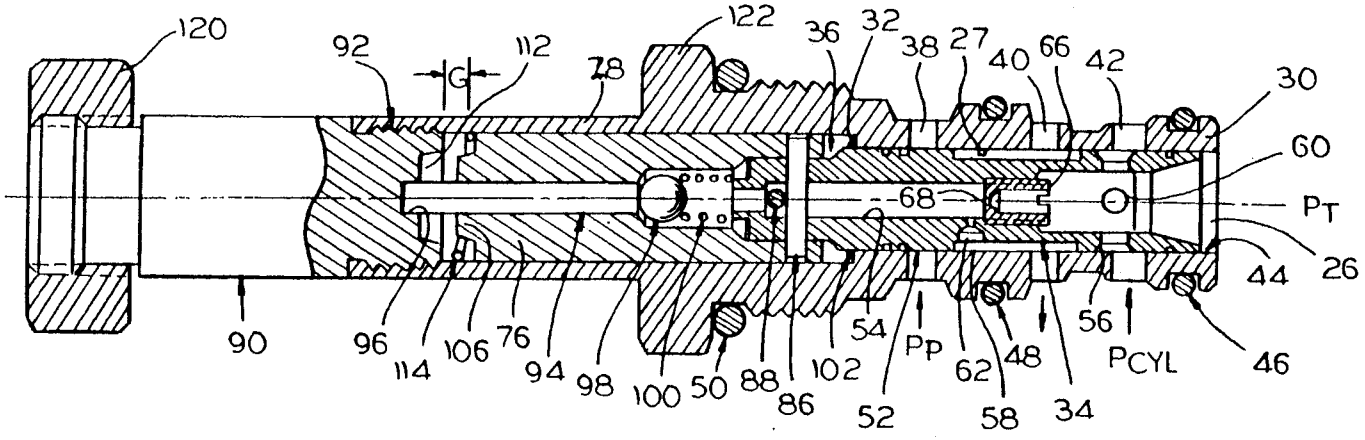
FIG. 4 is a sectional view taken along the line 4—4 of FIG. 1.

With reference also to FIG. 4, the valve housing 22 is of elongate, one-piece cylindrical construction having an axial through bore 26 defining an interior chamber 27. The bore is of a larger diameter at a sleeve end 28 than at a port end 30 to define an intermediate shoulder 32. The shoulder 32 separates the interior chamber 27 into a valve chamber 34 and a plunger chamber 36.

As used herein, the relative term "outer" or "outward" refers to a direction axially toward the port end 30, and the relative term "inner" or "inward" refers to a direction axially away from the port end 30, i.e., axially toward the sleeve end 28.

The valve housing 22 is provided with three axially spaced groups of circumferentially spaced side ports or openings 38, 40 and 42 that open radially inwardly into the valve chamber 34. An outer end of the bore 26 comprises an end port 44. A first sealing ring 46 is provide on the valve housing 22 for sealing the end port from the ports 38, 40 and 42. A second sealing ring 48 is provided between the first and second group of openings 38 and 40 for sealing the same from one another. A third sealing ring 50 is provided for sealing the valve 10 within the fluid port.

Advantageously, the one-piece valve housing 22 is of a non-magnetic material such as, for example, aluminum, brass, bronze or stainless steel. This design is believed less expensive than the two-piece design with the non-magnetic tube and magnetic valve housing and eliminates the requirements for filters or screens in fluid ports, in use.

Figure 6:
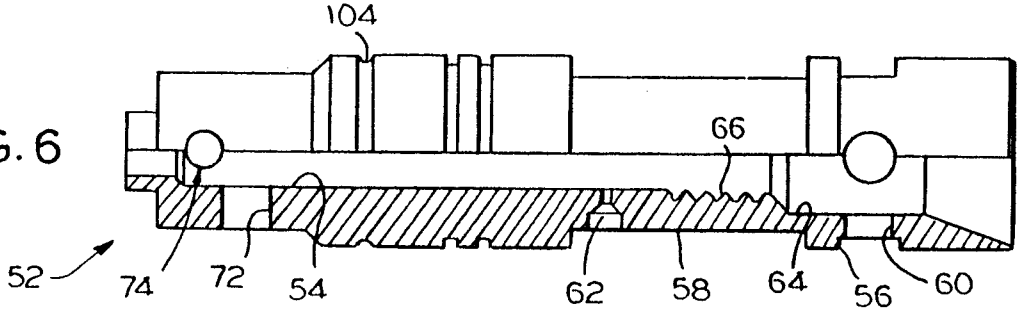
FIG. 6 is a partial sectional view of a spool of the valve of FIG. 1.

A flow control element such as a spool or valve member 52 is movable in the valve chamber 34 for selectively fluidically coupling the port openings 38, 40, 42 and 44. Particularly, and with reference also to FIG. 6, the valve member 52 is of cylindrical construction including an axial through bore 54. The outer diameter of the valve member 52 is slightly less than the inner diameter of the valve housing axial bore 26 at the port end 30. A first annular circumferential groove 56 is provided proximate an outer end of the valve member 52. An elongate circumferential annular groove 58 is centrally located on the valve member 52. A plurality of circumferentially spaced openings 60 open radially inwardly from the first groove 56 into the through bore 54. A single orifice 62 opens radially inwardly from the elongate groove 58 into the through bore 54.

The axial through bore 54 widens at a counterbore 64 at the outer end. The through bore 54 is threaded as at 66 immediately inwardly of the counterbore 64. The threaded portion 66 is adapted to receive a threaded plug 66, see FIG. 1. The plug 66 restricts fluid flow through the bore 54 and includes an axial orifice 68. Particularly, the orifice 68 is disposed axially outwardly of the spool orifice 62.

Figure 3:
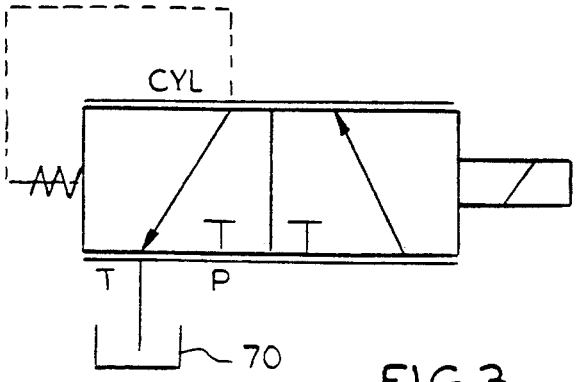
FIG. 3 is a hydraulic schematic of the valve of FIG. 1.

In a neutral valve position, as illustrated in FIG. 4, the end port 44 is connected through the valve member counterbore 64 and openings 60 to the third port openings 42. When actuated, the valve member 52 moves inwardly to cover the third port openings 42 and the central annular groove 58 provides fluidic coupling through the valve chamber 34 between the first openings and the second openings 40. Particularly, the amount of movement of the valve member 52 is controlled to control overlap between the first openings 38 and the groove 58 to regulate flow to the second openings 40. Typically, in an application for controlling a single acting cylinder, the end port 44 is connected to a tank 70, see FIG. 3, the first port openings serve as an inlet connected to a source of pressure, such as a pump P, while the second and third openings 40 and 42 serve as an outlet connected to the cylinder. Thus, in a neutral position, the cylinder is evacuated to the tank 70. In the regulated position, the cylinder is alternately connected either to the pressure source or to the tank.

An inner end of the valve member 52 includes a pair of angularly and axially spaced overlapping radially extending cylindrical openings 72 and 74. Particularly, the openings 72 and 74 are perpendicular relative to one another. The outermost opening 72 is of a larger diameter than the innermost opening 74.

Figure 5:
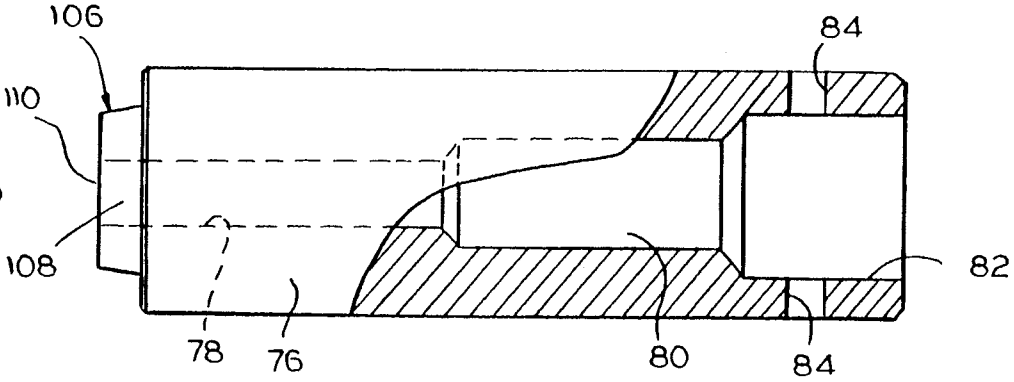
FIG. 5 is a partial sectional view of a plunger of the valve of FIG. 1.

A movable armature or plunger 76 is positioned in the housing at the sleeve end 28, i.e., in the plunger chamber 36. With reference also to FIG. 5, the plunger 76 includes an axial throughbore 78 coaxial with a first counterbore 80 of a larger diameter and a second counterbore 82 at an outer end of the plunger and of a still larger diameter. A radially extending through opening 84 opens into the second counterbore 82.

The plunger 76 is operatively connected to the valve member 52 using first and second cylindrical pins 86 and 88. The second pin 88 is received in the valve member second opening 74 and is of a length less than the inner diameter of the plunger second counterbore 82 to be captured therein. The first pin 86 is received in the valve member first opening 72 and also the plunger opening 84, as shown in FIG. 4.

A stop 90 is threaded to the housing sleeve end 28, as at 92. The stop 90 retains the plunger 76 in the plunger chamber 36. A cylindrical pin 94 extends through the plunger axial bore 78 and is received in a circular recess 96 in the stop 90. The pin 94 extends inwardly into the plunger first counterbore 80. A spherical ball 98 is contained in the plunger first counterbore 80 and is disposed between the pin 94 and a coil spring 100 acting on an inner end of the valve member 52. The helical coil spring 100 effectively acts between the stop 90, via the pin 94 and ball 98 to bias the valve member 52 outwardly to the neutral position shown. Outward movement is limited by a ring 102 received in a third axial groove 104, see FIG. 6, of the valve member 52 acting against the shoulder 32.

The plunger 76 includes a nose 106 at its inner end. The nose 106 has a conical surface 108 truncated at a flat axial end surface 110 to provide a frusto-conical configuration. The stop 90 includes a recess 112 facing the plunger nose 106. The recess 112 is complementary to the nose 106. Particularly, the recess 112 is also frusto-conical and of a size corresponding to the size of the nose 106 for receiving the same. A shim 114 in the form of a single coil spring 114 is disposed between the plunger 76 and stop 90.

The shim 114 prevents contact between the plunger 76 and stop 90, which eliminates problems in separation, i.e., sticking. It operates not only as shim but as a high rate spring which eliminates pressure spikes.

In the described configuration, a gap G, see FIG. 4, is provided between the stop 90 and the plunger 76. The gap G represents the distance between the plunger 76 and stop 90, less the thickness of the shim 114. The use of the frusto-conical nose and recess surfaces eliminates sharp edges in the mateable parts to provide improved performance. Further, there is a sufficient material thickness between the outer circumference of the plunger 76 and stop 90 and the break between the nose 106 is received in the recess 112. This increased material thickness increases force characteristics of the valve 10.

In order to actuate the valve 10, a solenoid coil 116, surrounded by a metal yoke 118, is received around the housing sleeve 28 and the stop 90. A nut 120 is threaded at an inner end of the stop 90 and retains the solenoid 116 positioned between the nut 120 and a coupling nut portion 122 of the valve housing 22 intermediate the port end 30 and sleeve end 28.

When the solenoid 116 is energized, it develops a magnetic force in space occupied by the plunger 76. The magnetic force moves the plunger 74 inwardly to draw the valve member 52 against the force of the pressure differential over the valve member 52 and the spring 100 to move the valve member 52 to the regulated position, discussed above. De-energization of the solenoid 116 eliminates the force on the plunger 76 so that the pressure differential over the valve member 52 and the coil spring 100 returns the valve member 52 to the neutral position illustrated.

Figure 7:
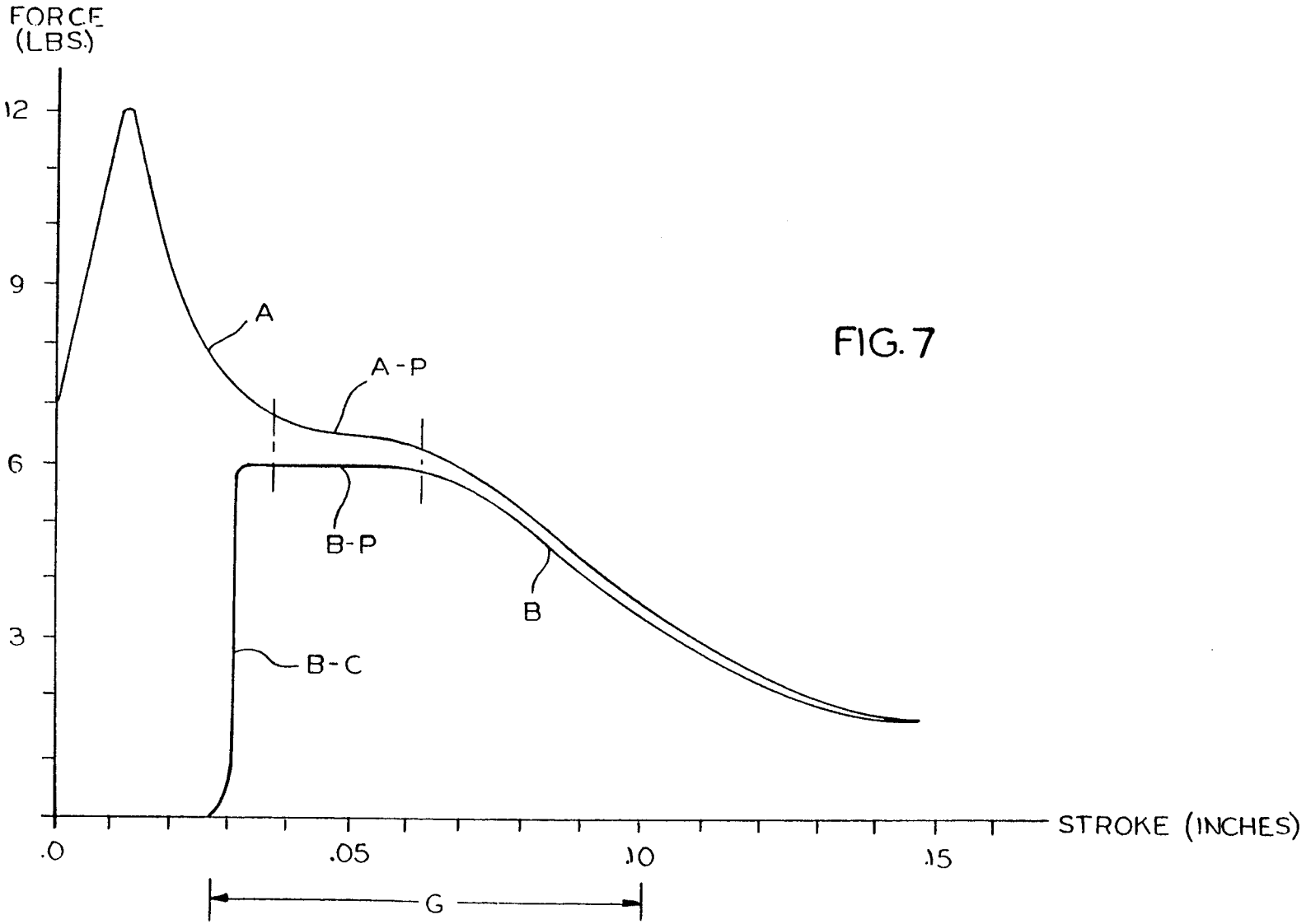
FIG. 7 is a graph illustrating curves showing force versus stroke for the valve of FIG. 1.

With reference to FIG. 7, a series of curves illustrate operation of the valve 10. The X axis of the curve represents stroke or gap, in inches. The Y axis represents force, in pounds. A first curve labeled "A" illustrates the relationship between stroke and force, ignoring effect of the coil spring 100 and shim 114. Particularly, the curve "A" illustrates the well-known result that force is generally inverse to stroke. The effect of the frusto-conical nose 106 and frusto-conical recess 112 is to provide a generally horizontal portion of curve "A", labeled A-P. This generally horizontal portion A-P results when the nose 106 is received within the recess 116.

The proportional area A-P is relatively short and not ideally horizontal. However, the area A-P is at a higher force level than prior valves. The shorter length is satisfactory as the gap "G" is relatively short. The non-horizontal nature of the portion A-P is corrected by the coil spring 100 and the shim 114. Particularly, the curve "B" represents the force stroke curve when the coil spring 100 and shim 114 are included. Particularly, the spring 100 and the shim 114 results in a proportional area B-P which is more horizontal than the portion A-P. The shim 114 also cuts off the end of movement of the plunger 76, which is represented by the curve portion B-C. The area of movement represented by the gap "G" is illustrated in the drawing between the portion B-C and the stroke value 0.1.

With a pull-type solenoid, as shown, it is necessary to operatively connect the plunger 76 and valve member 52, as described above. Depending on the connection provided, problems with concentricity can result. The use of the two pins 86 and 88, as described, compensates for non-concentricity and minimizes problems with friction. Particularly, movement of the plunger 76 results in movement of the first pin 86 which is translated into movement of the second pin 88 and thus movement of the valve member 52. Because the inner diameter of the valve member first opening 72 is larger than the outer diameter of the first pin 86, the first pin 86 does not act directly on the valve member 52. Instead, it acts on the second pin 88 which is perpendicular thereto to provide a one-point connection at the tangent of the two perpendicular pins, i.e., the central axis of the valve 10, to eliminate frictional distortion.

As is well known, the magnetic force generated by the solenoid 116 is proportional to voltage applied thereto. The voltage level is regulated so that the curve B of FIG. 7 is effectively raised or lowered generally proportional to the voltage level. This voltage induces inward movement of the plunger 52 according to the force curve, as long as the magnetic force exceeds the opposing forces. The valve 10 is designed so that the main opposing force is the force of pressure differential over the valve member 52. Thus, the solenoid 116 moves the plunger 76 until the forces are balanced, so that the valve member 52 stops in an intermediate position. Particularly, in this intermediate position the valve member 52 connects the cylinder with the pressure source and the tank in such a proportion that an intermediate cylinder pressure proportional to voltage is established.

It is desirable that the pressure capacity of the valve 10 be increased without decreasing spool diameter. As is known, decreasing spool diameter decreases flow capacity In accordance with the invention, for a given solenoid force, a bypass flow path is provided from the cylinder to the tank, as illustrated schematically in FIG. 3, using the two orifices 62 and 68. The orifices 62 and 68 divide the pressure drop from the cylinder to the tank into two fractions so that the solenoid force has to balance the force created by only one fraction instead of the entire pressure drop.

More particularly, as current is applied to the solenoid 116, the valve member 52 is pulled so that the valve member starts to open the first set of openings 38 and close the third set of openings 42. Pressure increases in the cylinder via the second set of openings 40. Fluid also fills the plunger chamber 36 through the first orifice 62 into the valve member through bore 54 which acts as a pressure chamber. This pressure acts on the cross sectional area of the valve member 52 to oppose the solenoid force. When all forces are balanced, then movement of the valve member 52 stops. If pressure subsequently becomes too high, then the valve member 52 is moved outwardly to release pressure to the port opening 44, and thus the tank, until balance is restored.

In accordance with the invention, the valve 10 is a universal valve which can be used for different pressure applications. This is accomplished by suitably selecting the size of the orifice 68 in the plug 66. For example, a plurality of different plugs 66, each having a different size orifice 68, can be selected from to determine pressure capacity of the valve 10. An additional flow path extends from the cylinder through the spool orifice 62 and the second orifice 68 to the tank via the end port opening 44. Particularly, the orifices 62 and 68 create a pressure dividing mechanism. By varying the size of the second orifice 68, the pressure acting on the valve member 52 is selected to determine pressure capacity so that the solenoid force only has to balance the force created by the difference between the pressure acting on the valve member and the pressure of the tank.

Thus, in accordance with the invention, a low-cost proportional valve is provided owing to the use of the one-piece housing. Furthermore, the frusto-conical relationship between the plunger nose and stop provides increased force characteristics. The pressure dividing mechanism increases regulated pressure capacity without decreasing spool diameter. Finally, the coupling between the plunger and valve member decreases friction and net axial forces on moving parts.

I claim:

1. A proportional solenoid operated fluid pressure control valve comprising:

an elongate cylindrical valve housing having an axial through bore defining an interior chamber, one end of said chamber comprising an end port opening, a plurality of axially space side port openings defining an inlet and an outlet, and an axial opposite end comprising a sleeve end receivable in a solenoid, in use;

a valve member movable in said chamber at the port end for selectively controlling fluid flow through said interior chamber between said end port opening and said outlet in a neutral position or between said inlet and said outlet in a regulated position;

a solenoid plunger movable in said interior chamber at the sleeve end operatively associated with the valve member for positioning the valve member; and pressure dividing means for dividing regulated pressure between the outlet and the end port opening in the regulated position of the valve member to create an intermediate pressure to balance a force from the solenoid.

2. The pressure control valve of claim 1 wherein said pressure dividing means comprises a pressure chamber in said valve member, a first orifice connecting said pressure chamber with said outlet and a second orifice connecting said pressure chamber with said end port opening.

3. The pressure control valve of claim 2 wherein said second orifice is of a size selected to determine pressure capacity of the valve.

4. The pressure control valve of claim 2 wherein said pressure chamber is defined by a through bore in said valve member and further comprising a plug threadably received in said through bore, said threaded plug including said second orifice.

5. A solenoid operated fluid pressure control valve comprising:

an elongate cylindrical valve housing having an axial through bore defining an interior chamber, one end of said chamber comprising a port end having an inlet and an outlet, and an axial opposite end comprising a sleeve end receivable in a solenoid, in use;

a valve member movable in said chamber at the port end for selectively controlling fluid flow through said interior chamber between said inlet and said outlet;

a solenoid plunger movable in said interior chamber at the sleeve end; and means for operatively coupling said plunger to said valve member for positioning the valve member, comprising one end of the valve member being received in a counterbore in said plunger, said one end including a pair of angularly and axially spaced overlapping radially extending openings, a first cylindrical pin received in one of said openings and extending into aligned radially extending openings in said plunger and a second pin being received in the other of said openings and being captured in said counterbore, so that movement of said plunger and thus said first pin is translated into movement of said second pin and thus said valve member to compensate for nonconcentricity between said parts moving relative to one another and eliminate frictional distortion.

6. The pressure control valve of claim 5 wherein said one radially extending valve member opening is of a larger diameter than said other radially extending valve member opening.

7. A proportional solenoid operated fluid pressure control valve comprising:

an elongate cylindrical valve housing having an axial through bore defining an interior chamber, one end of said chamber comprising an end port opening, a plurality of axially spaced side port openings defining an inlet and an outlet, and an axial opposite end comprising a sleeve end receivable in a solenoid, in use;

a valve member movable in said chamber at the port end for selectively controlling fluid flow through said interior chamber between said end port opening and said outlet in a neutral position or between said inlet and said outlet in a regulated position;

pressure dividing means for dividing regulated pressure between the outlet and the end port opening in the regulated position of the valve member to create an intermediate pressure to balance a force from the solenoid;

a solenoid plunger movable in said chamber at the sleeve end and operatively associated with the valve member for positioning the valve member said plunger including a conical nose extending axially from an end opposite said valve member; and a stop mounted to said housing at the sleeve end for retaining the plunger in said interior chamber, said stop including a conical recess axially facing said plunger nose for receiving the plunger nose.

8. The pressure control valve of claim 7 wherein said nose comprises a frusto-conical nose and said recess comprises a frusto-conical recess.

9. The pressure control valve of claim 7 wherein housing comprises a one-piece housing of non-magnetic materials.

10. The pressure control valve of claim 7 further comprising a non-magnetic shim disposed between said plunger and said stop to limit movement of said plunger and to correct solenoid characteristics.

11. The pressure control valve of claim 10 wherein said shim comprises a single coil spring.

12. The pressure control valve of claim 7 further comprising a spring for normally biasing said plunger in a select neutral position.

13. The pressure control valve of claim 7 wherein said pressure dividing means comprises a pressure chamber in said valve member, a first orifice connecting said pressure chamber with said outlet and a second orifice connecting said pressure chamber with said end port opening.

14. The pressure control valve of claim 13 wherein said second orifice is of a size selected to determine pressure capacity of the valve.

15. The pressure control valve of claim 13 wherein said pressure chamber is defined by a through bore in said valve member and further comprising a plug threadably received in said through bore, said threaded plug including said second orifice.

* * * * *